United States Patent [19]

Eroyan

[11] 4,228,947

[45] Oct. 21, 1980

[54] SELF-SECURING BOX CONSTRUCTION

[76] Inventor: Gary Eroyan, 1314 N. Crawford St., Detroit, Mich. 48209

[21] Appl. No.: 30,012

[22] Filed: Apr. 16, 1979

[51] Int. Cl.[3] ..... B65D 5/10; B65D 65/12; B65D 65/14

[52] U.S. Cl. ..... 229/39 R; 229/87 R; 40/21 R

[58] Field of Search ..... 229/39 R, 37 R, 8, 87 R; 206/83.5, 442, 427; 40/21 R, 2 G

[56] References Cited

U.S. PATENT DOCUMENTS

| | | | |
|---|---|---|---|
| 224,958 | 2/1880 | Rowland | 40/21 R |
| 1,566,196 | 12/1925 | Garcia | 229/39 R |
| 1,808,772 | 6/1931 | Ethridge | 229/39 R |
| 1,840,425 | 1/1932 | Andrews | 40/2 G |
| 2,308,128 | 1/1943 | Tammer | 229/39 R |
| 2,373,423 | 4/1945 | Shina | 229/39 R |
| 2,678,770 | 5/1954 | Bonini | 206/45.33 X |
| 3,127,090 | 3/1964 | Scott, Jr. | 229/39 R X |
| 3,178,096 | 4/1965 | Reeves et al. | 229/39 R |
| 3,394,867 | 7/1968 | Gregg | 229/87 R X |
| 3,460,738 | 8/1969 | Adams et al. | 229/37 R |
| 3,790,069 | 2/1974 | Straccamore | 229/39 R X |
| 4,005,814 | 2/1977 | Foster | 229/39 R |

FOREIGN PATENT DOCUMENTS

| | | | |
|---|---|---|---|
| 4005814 | 2/1977 | Fed. Rep. of Germany | 229/39 R |

*Primary Examiner*—Davis T. Moorhead

*Attorney, Agent, or Firm*—Cullen, Sloman, Cantor, Grauer, Scott & Rutherford

[57] ABSTRACT

A self-securing box is formed from a blank which is cut, scored, folded and secured to define an open ended tube having a top with foldable outer end flaps, a bottom with foldable inner end flaps and sides with foldable end tabs. Each of the tabs adjacent the outer end flaps have an acute angular edge portion therein. The respective tabs, inner flaps and outer flaps at opposite ends of the tube are folded successively 90 degrees into engaging registry. The sides of the outer flaps define lock edges which are included at an acute angle so as to normally overlap the tab edge portions and are adapted for manual flexing interlocking inward projection so as to retainably engage interior portions of the adjacent tab at the edge portion. A hollow preformed simulated ribbon of stiff material is rectangular in longitudinal cross-section and is formed as a closed loop so as to longitudinally extend around the top, bottom and folded end flaps. The sides of the inner end flaps are inclined at an acute angle whereby when said tabs and flaps are folded over and secured together, the box has the appearance of being wrapped.

13 Claims, 25 Drawing Figures

FIG. 1
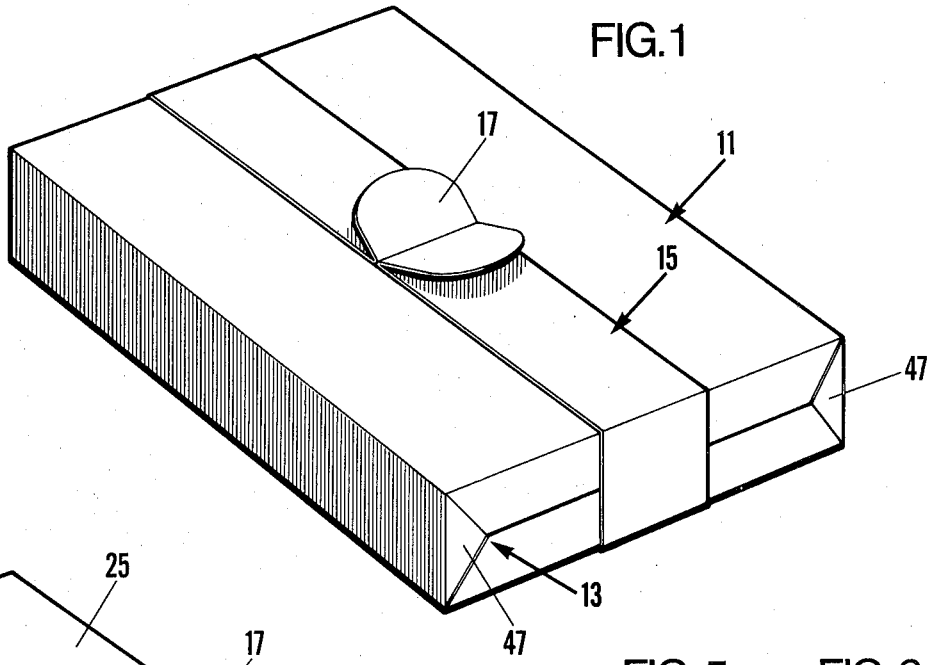
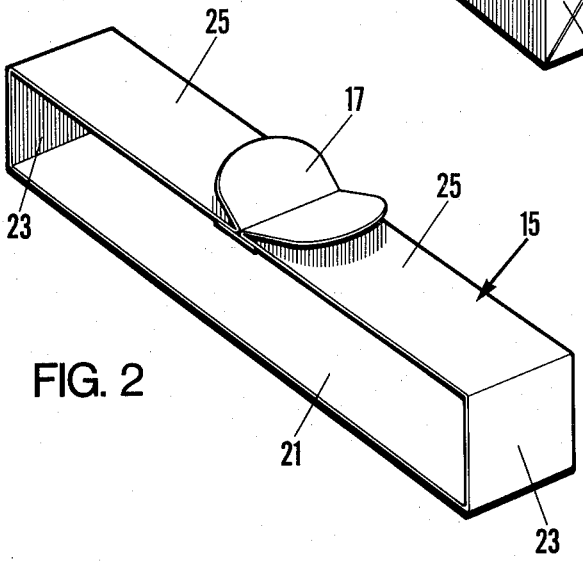
FIG. 2
FIG. 5
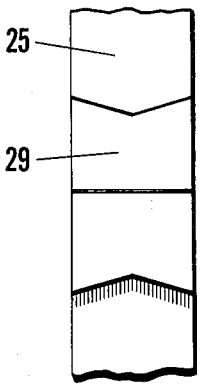
FIG. 6
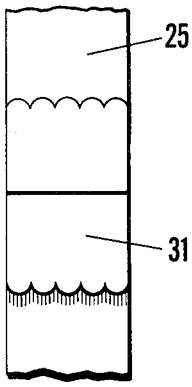
FIG. 4
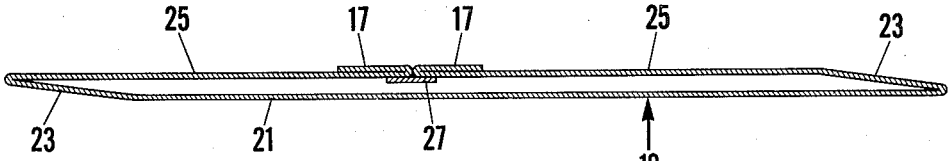
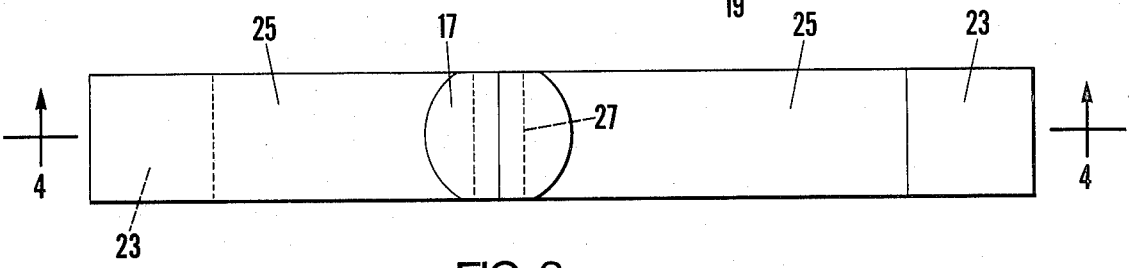
FIG. 3

FIG. 8
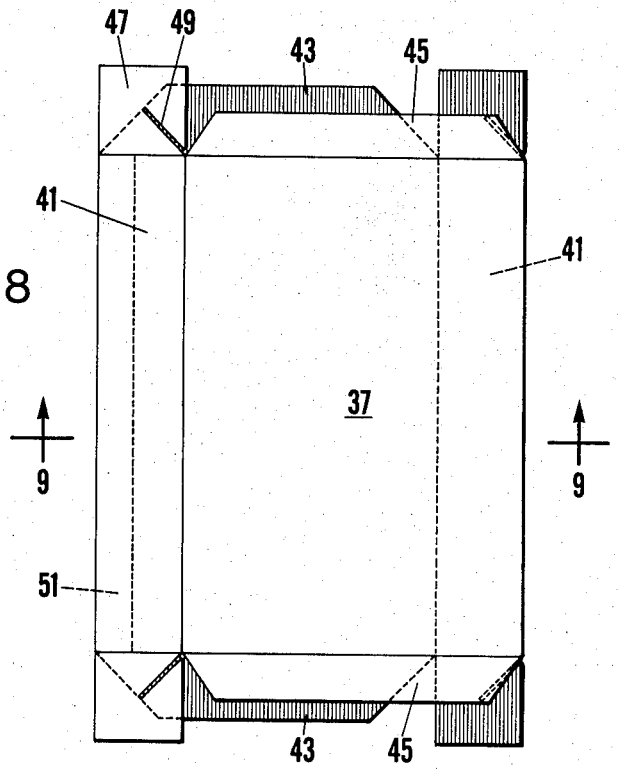
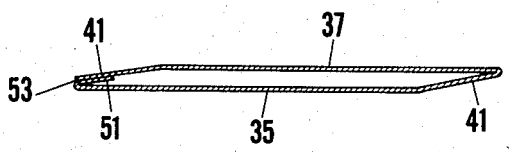
FIG. 9
FIG. 7
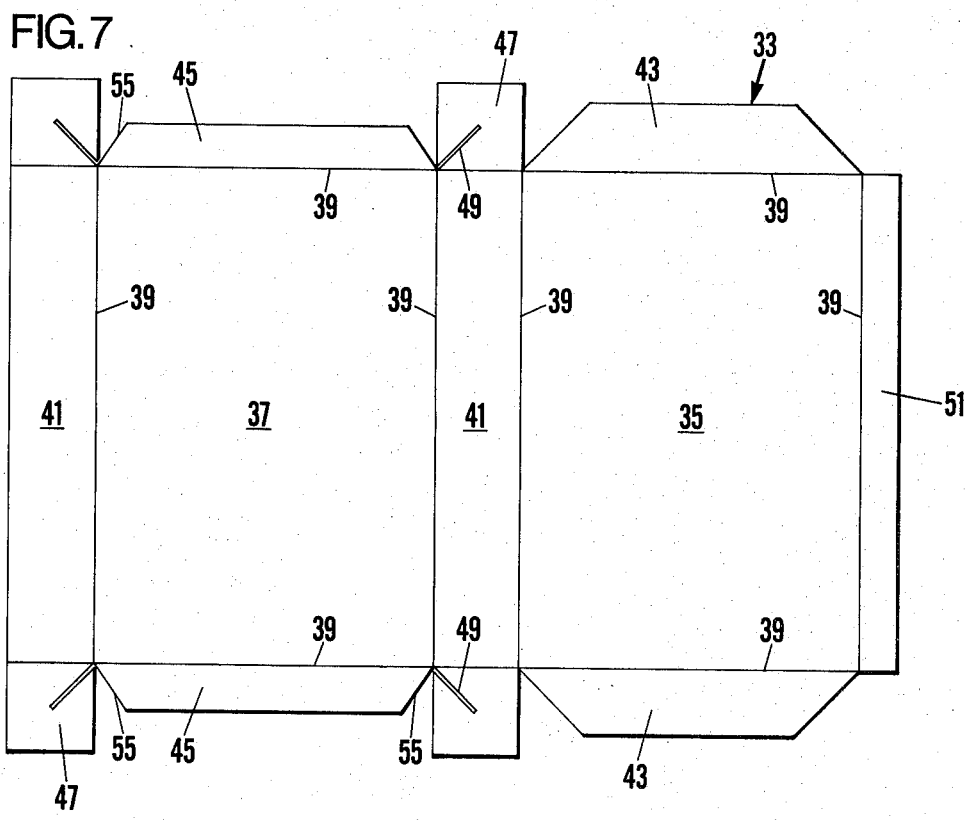

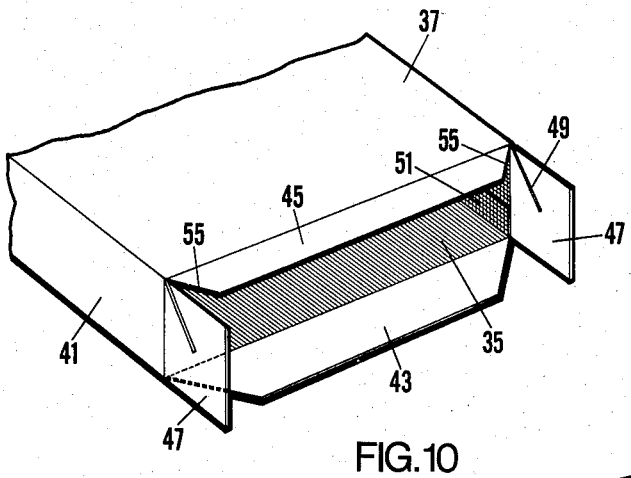
FIG. 10
FIG. 13
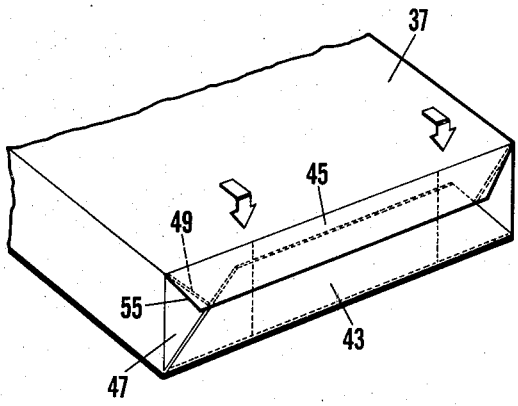
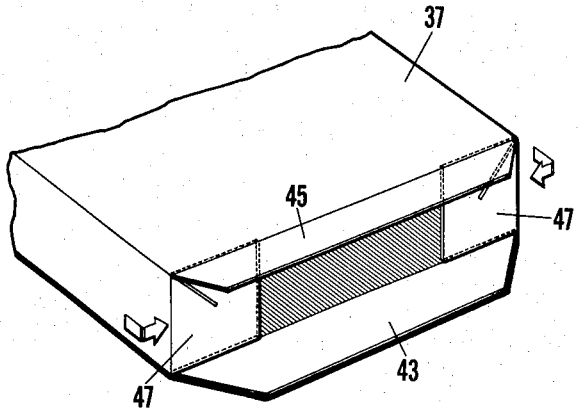
FIG. 11
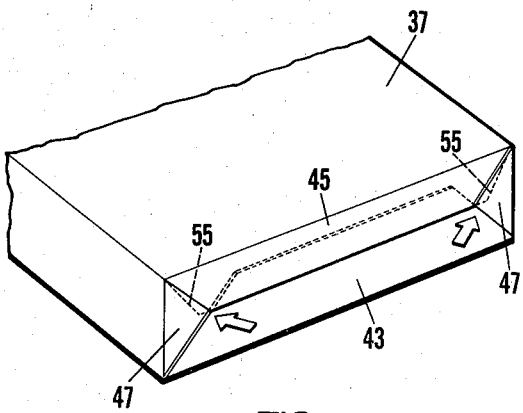
FIG. 14
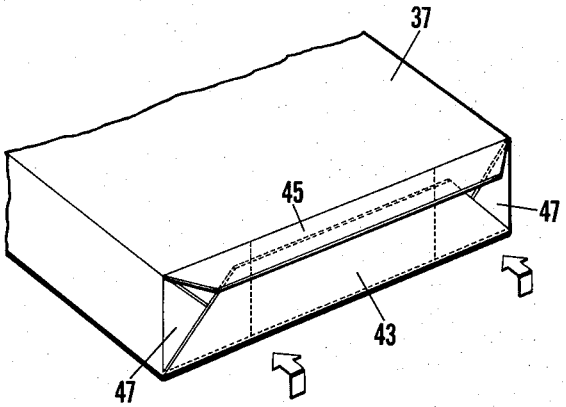
FIG. 12

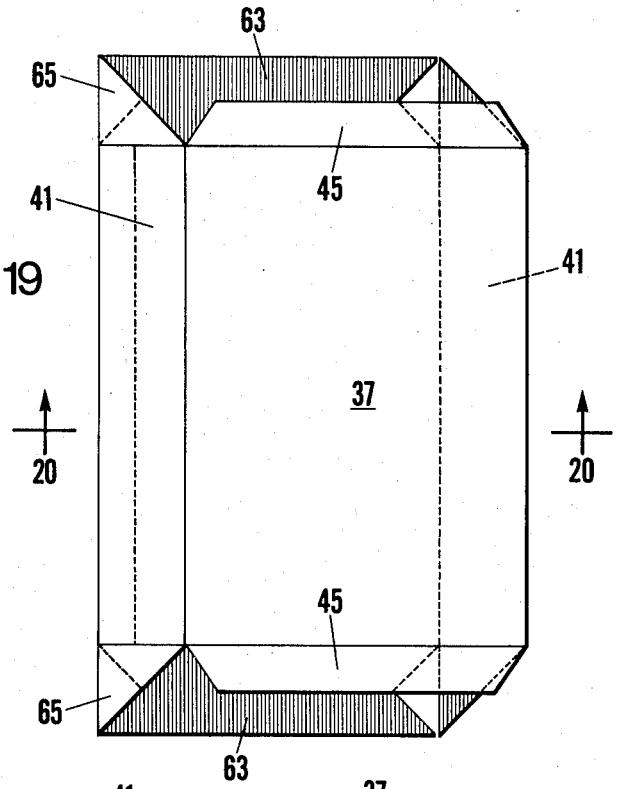
FIG. 19
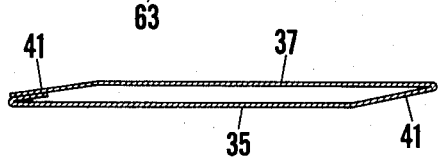
FIG. 20
FIG. 18
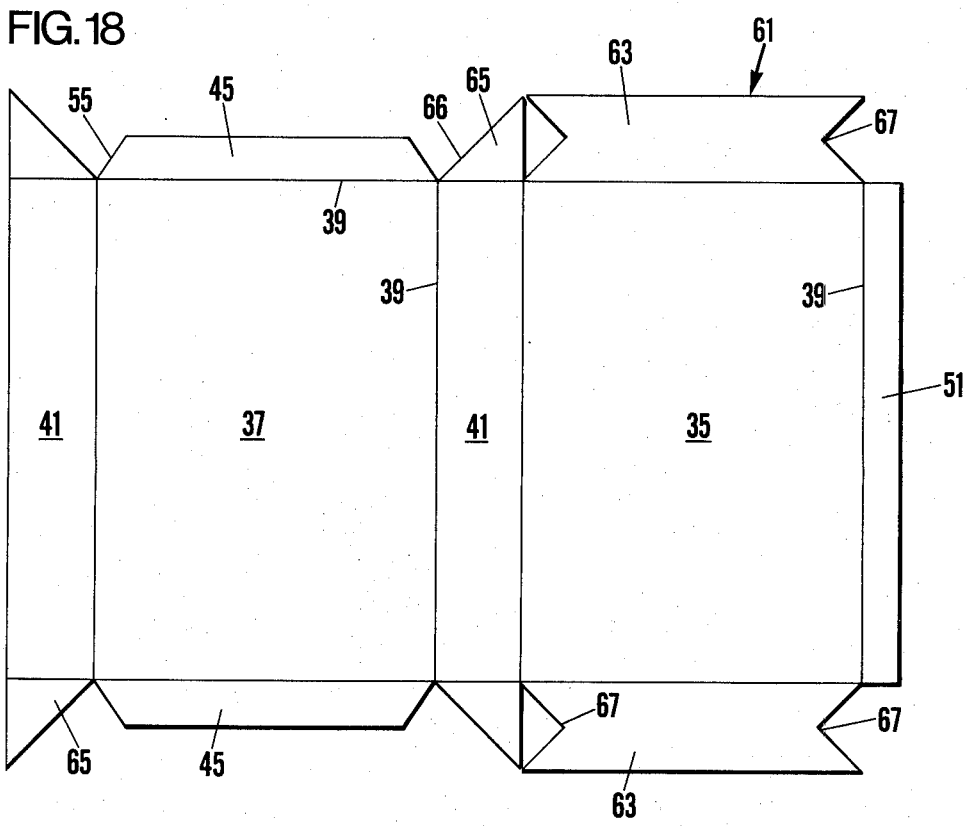

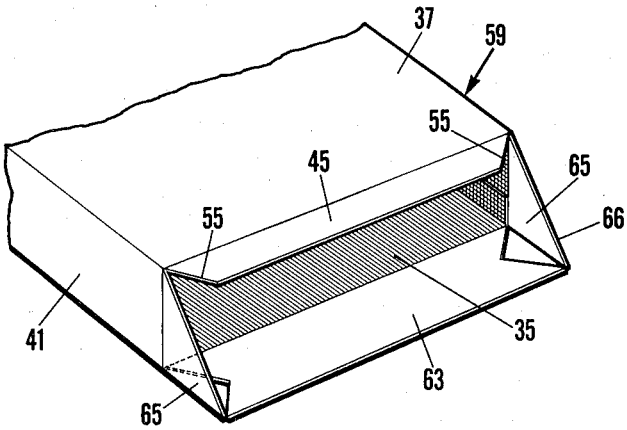
FIG. 21
FIG. 24
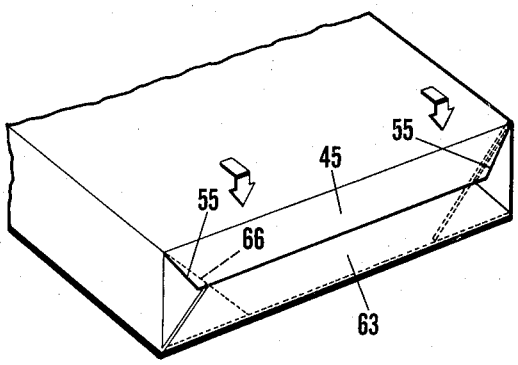
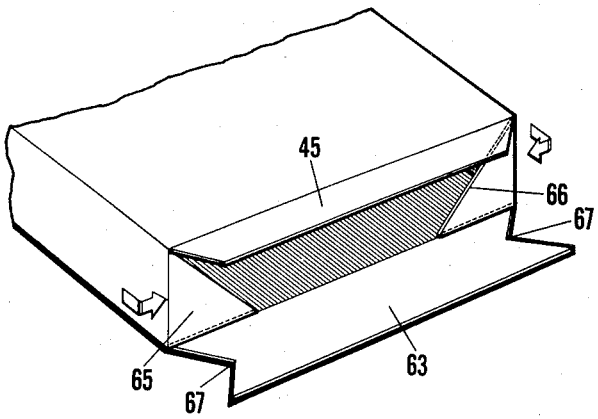
FIG. 22
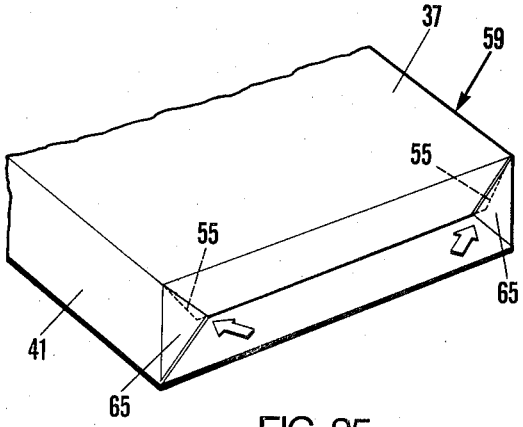
FIG. 25
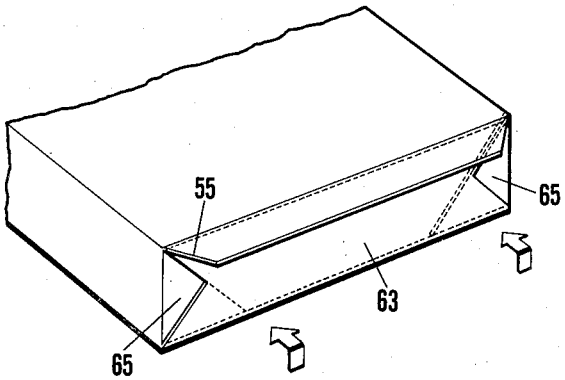
FIG. 23

SELF-SECURING BOX CONSTRUCTION

BACKGROUND OF THE INVENTION

Heretofore box constructions have been provided which are selfsecuring by the use of tabs and flaps which interlock in such a manner as to render it difficult to open the box and reclose same without damaging such tabs and flaps. An example of a similar prior art carton is shown in U.S. Pat. No. 3,460,738. Generally self-locking tabs are shown in U.S. Pat. No. 2,481,288. Examples of self-locking wrap-around bands or straps for packages are shown in the following patents: U.S Pat. Nos. 1,840,425; 2,004,098; 2,678,770; 3,127,090. Related box constructions are further shown in the following additional patents: U.S. Pat. Nos. 676,015; 3,245,604; 3,462,066; 3,790,064; 3,790,069. The foregoing patents were found as a result of a search conducted in the following Classes and Sub-classes: Class 53, Sub. 329; Class 206, Sub 249 and 457; Class 220 Subs. 403 and 463; Class 229, Sub. 8, 16, 33, 36, 38, 39R, 41, 45, and 87R and Design Class D9, Subclasses 222, 229, 230, 231–235, 244, 245.

SUMMARY OF THE INVENTION

The present invention is directed to a self-securing box which has been formed from a blank which is cut, scored, folded and laterally secured to define an open ended tube. Such box has a top with foldable outer end flaps a bottom with foldable inner end flaps and sides with foldable end tabs. Each of the tabs adjacent the outer end flaps have an acute angular edge portion such as an angular slit or may be defined by a tab which is triangular in shape. The respective tabs, inner flaps and outer flaps at opposite ends of the tube are folded successively through 90 degrees into engaging registry. The sides of the outer end flaps define lock edges which are inclined at an acute angle so as to normally overlie the tab angular edge portions and are adapted for manual flexing interlocking inward projection so as to retainably engage interior portions of the adjacent tab at said edge portion or slit, each outer flap retainably engaging an inner flap.

The angular edge portions, being one side of a triangular tab, or a slit formed in the tab extend at an acute angle of approximately 45 degrees. The lock edges on the sides of the outer end flaps are similarly inclined but at a slightly greater angle so as to overlap the tab angular edge portion and after inward deflection pass the angular edge portions and underlap the tabs respectively while retainably engaging the inner end flaps.

The inner end flaps have a heighth greater than the outer end flaps so that the outer end flaps overlie and retainably engage said inner end flaps. The sides of the inner end flaps are inclined at an acute angle whereby when the tabs and flaps are folded over and secured together, the box has the appearance of being wrapped.

A hollow pre-formed simulated ribbon of stiff material and rectangular in longitudinal cross-section formed as a closed loop, is adapted to longitudinally extend around the top, bottom and folded end flaps of the box.

It is a primary object of the present invention to provide an improved self-securing box construction and wherein the tabs and flaps are so formed that while an interlock is provided for securing the box at a closed condition, the box may be opened at either end and reclosed conveniently without damage to the tabs or flaps.

Essentially, the outer end flaps which overlie the inner end flaps and the folded tabs have acute angular lock edges which are inclined at an acute angle so as to normally overlap the angular edge portions or slits formed in the adjacent tabs. Their construction facilitates easy manual flexing and interlocking inward projection of the lock edges over said angular edge portions or slits so as to retainably engage interior portions of the adjacent tab and with the outer end flaps retainingly engaging the inner flaps.

These and other objects will be seen from the following specification and claims in conjunction with the appended drawings.

THE DRAWINGS

FIG. 1 is a perspective view of the present self-securing box having an appearance of being wrapped and including a hollow pre-formed simulated ribbon and bow thereon.

FIG. 2 is a side perspective view of the prefabricated ribbon shown in FIG. 1.

FIG. 3 is a plan view of the ribbon of FIG. 2, but vertically collapsed.

FIG. 4 is a section taken in the direction of arrows 4—4 of FIG. 3.

FIG. 5 is a fragmentary plan view of a ribbon showing a modified bow construction.

FIG. 6 is a similar view of a ribbon having a further modified bow.

FIG. 7 is a plan view of a blank which has been cut and scored and which is adapted for folding to the present self-securing box shown in FIG. 1.

FIG. 8 is a plan view of such box which has been folded and with the sides secured to define an open ended tube and which has been flattened for storage or packing prior to use.

FIG. 9 is a section taken in the direction of arrows 9—9 of FIG. 8.

FIG. 10 is a fragmentary perspective view of the present self-securing box formed as an open-ended tube and wherein respective flaps and tabs are unfolded.

FIG. 11 is a similar view with the end tabs folded.

FIG. 12 is a similar view with the inner end flap folded over the tabs.

FIG. 13 is a similar view with the outer end flap folded over the inner end flap and tabs.

FIG. 14 is a similar view of the box construction from one end with the side edges of the outer end flaps defining locking edges flexed inwardly into interlocking projection past the angular edge portions or slits in the tabs such as shown in FIG. 10 to provide an interlock.

FIG. 18 is a plan view of a modified blank for a self-securing box similar to FIG. 7.

FIG. 19 is a plan view of a partly formed self-securing box which has been folded, secured and collapsed and corresponds to the blank of FIG. 18.

FIG. 20 is a section taken in the direction of arrows 20—20 of FIG. 19.

FIG. 21 is a fragmentary perspective view of one end of the partly formed box with the tabs and flaps unfolded.

FIG. 22 is a similar view with the tabs folded.

FIG. 23 is a similar view with the inner end flap folded over the tabs.

FIG. 24 is a similar view with the outer end flap folded over the inner end flap and tabs.

FIG. 25 is a similar view to lock the edges of the outer end flap flexed and interlocked with angular edge portions of the tabs.

Figure 15:
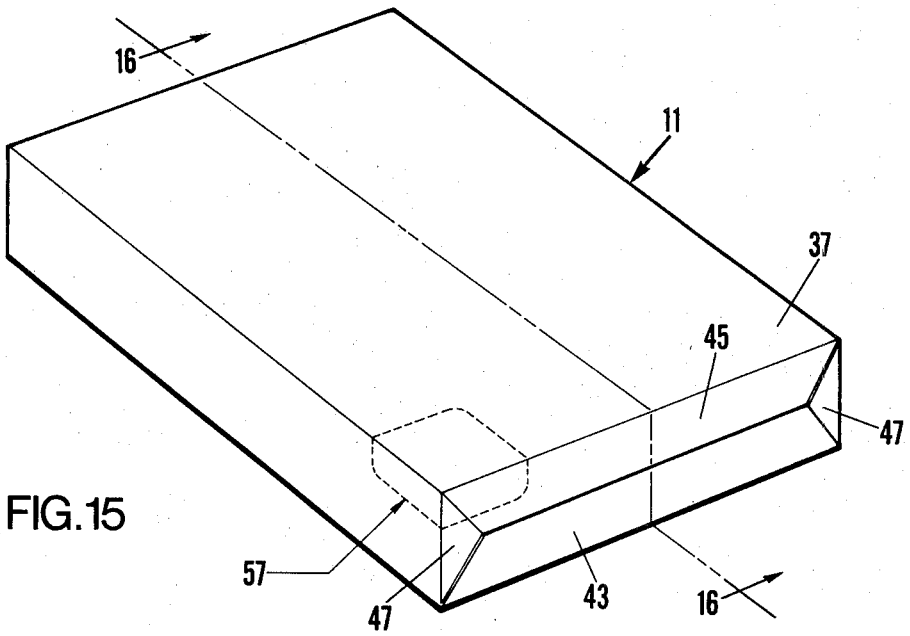
FIG. 15 is a perspective view of the self-securing box of FIG. 1 without the ribbon indicating a cut-away portion as at 57.

It will be understood that the above drawings illustrate merely two embodiments of the invention, and that other embodiments are contemplated within the scope of the claims hereafter set forth.

DETAILED DESCRIPTION OF AN EMBODIMENT OF THE INVENTION

The present self-securing box is designated at 11 in FIG. 1 with the end flaps and tabs so formed so that when folded are adapted to have the appearance of being wrapped as shown at 13. Preformed ribbon 15 of a stiff material having a pair of simulated bow tabs 17 is shown in a perspective view in FIG. 2 and shown assembled over the self-securing box in FIG. 1.

The preformed ribbon includes a strip body 19 of FIG. 4 with bottom strip 21, foldable ends 23 and a pair of inwardly directed top strips 25 which at their meeting ends are out-turned angularly to define the bow tabs 17. A transverse connector 27 bridges the undersurface of the registering top strips and is suitably secured thereto by adhesive to maintain the assembled loop formation of simulated ribbon shown in FIG. 2 of such dimension and size as to fit over the box longitudinally thereof as in FIG. 1.

Modified bow tabs 29 are shown in FIG. 5 as a part of the top strips 25. Further modified bow tabs 31 are shown in FIG. 6 as a part of the top strips 25 of the ribbon construction shown in FIG. 2.

The box 11 is formed from a blank 33, of cardboard or similar material which has been cut to define box bottom 35, box top 37 including a series of score lines 39, marking folding edges to further define box sides 41. The score lines further define the pair of foldable inner end flaps 43 at opposite ends of the bottom 35, the foldable outer end flaps 45 at opposite ends of the top 37 and the foldable tabs 47 at opposite ends of the sides 41. Each of the tabs 47 at opposite ends of the foldable outer end flaps 45, have acute angular edge portions which in the embodiment shown in FIG. 7 are in the form of slits 49 which extend at approximately a 45 degree angle with respect to the fold side of the tab.

The blank includes upon one side along the bottom 35 the elongated assembly flap 51 adapted for right angular folding along the score line 39 and whose side opposite from that shown in FIG. 7 is adapted for cooperative registry with and securing at 53 to an interior undersurface of the side 41 to thus provide an open ended tube as shown in FIGS. 8 and 9.

In this form of the self-securing box, the top and bottom have been brought together as they would be for storage or shipping with the top in substantial registry with the bottom and with the respective flaps and tabs coplanar with the corresponding top, bottom or sides of the unformed hollow tube.

FIGS. 10–14 are fragmentary perspective views of the self-securing box as formed into a tube by being folded along the respective score lines and wherein tabs 47, the inner end flap 43 and the outer end flap 45 are successively each folded to 90 degrees into overlapping engaging relationship as shown in FIGS. 13 and 14.

In FIG. 10, tabs and flaps are all unfolded and are respectively coplanar with the top, bottom and sides of the box.

FIG. 11 fragmentarily shows the first step of completing the box construction by the inward folding of the tabs 47, 90 degrees as designated by the arrows. FIG. 12 shows the further step of folding the inner end flap 43, 90 degrees so as to overlie the folded tabs 47 as designated by the arrows.

FIG. 13 shows the further step as designated by the arrows of the final folding of the outer end flap 45 over the inner end flap 43 all into parallel engaging registry but with the tabs and flaps unlocked.

The inner end flap 43 is of greater height than the outer end flap 45 so as to provide for the overlap thereof shown in FIGS. 13 and 14. The respective sides of the outer end flaps 45 provide lock edges 55 which are inclined at an acute angle so as to normally overlie the tab slits 49 as shown in FIG. 13. In the final step of securing the outer end flap 45 over the inner end flap 43 the lock edges 55 are manually flexed for interlocking inward projection into the slits 49 so as to retainably engage inner portions of the adjacent tab 47 at said slits at the same time retainably engaging the inner flap 43.

While in the illustrated embodiment the slits 49 are preferably at a 45 degree angle. This could be any other convenient acute angle as desired. It is only required that the locking edges of the outer end flaps be similarly inclined at an acute angle which is slightly greater than the angle of the slits so that the lock edges 55 such as shown in FIG. 13 overlie portions of the tabs 47 outwardly of the slits. It is this overlapping angular edge portion of the outer end flaps defining the lock edges which may be easily and manually flexed inwardly as designated by the arrow in FIG. 14 so that these lock edges project through respective slits 49 retainingly engaging interior portions of the adjacent tab at the slit.

In accomplishing this inward interlocking projection of the lock edges of the outer end flaps said lock edges then engage and underlie inner surface portions of the tabs 47 and at the same time flaps 45 retainingly engage the inner end flaps 43.

The interlock of the lock edges with respect to the slits is such that the self-secured box may be opened and closed a number of times without damage to the tabs or flaps. It is the interlock of the lock edges of the outer end flaps which respect the slits in the tabs 47 which completes the securing of one end of the box as shown in the steps of FIGS. 11–14.

Accordingly, in the present construction the blank is so formed that the tabs 47 are arranged at opposite ends of the outer end flaps 45 and thus adjacent to the lock edges 55 formed therein.

By the present construction wherein the respective edges of the inner and outer end flaps are inclined at acute angles, in the range of 45 degrees approximately, the folded and secured box of FIG. 1 has the appearance of being wrapped as shown at 13. The wrapping is completed by the use of the prefabricated, preformed tubular simulated ribbon 15 of FIG. 1 which has been frictionally slid over the box lengthwise thereof to the central position shown. This completes the self-locking box which has the appearance of being wrapped in view of the angularity of the ends of the flaps and their overlap as best shown in FIG. 1.

Figure 17:
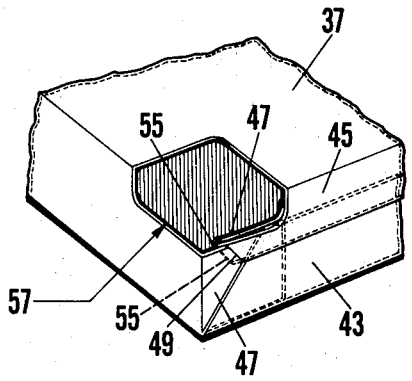
FIG. 17 is a fragmentary perspective view of the box shown in FIG. 15 which has been cut away to illustrate the flap and tab interlock.

FIG. 15 is a perspective view of the present assembled self-securing box which has designated at 57 a cut-away of one corner thereof. Such cut-away is shown on a larger scale at 57, FIG. 17. The respective locking edge 55 of the outer end flap 45 has been inwardly projected through the slit 49 so as to retainingly engage the inner surface of tab 47 at the same time retainingly engaging adjacent underlapped portions of the inner end flap 43.

Figure 16:
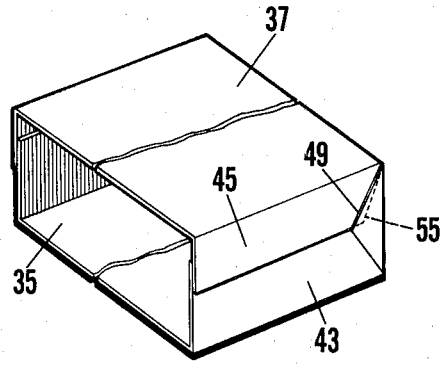
FIG. 16 is a fragmentary perspective broken away view taken in the direction of arrows 16—16 of FIG. 15.

This interlock is also shown with lock edge 55 in dash lines in the final secured position in FIG. 16.

MODIFIED SELF-SECURING BOX

A modified self-securing box is designated at 59 in FIGS. 21-25 and which is formed from a blank 61, FIG. 18 which has been cut and scored as above described at 39 which again defines the same and not fully described. bottom 35, top 37, sides 41, and outer end flaps 45.

The modification is in the form of the tab 65 at the ends of the sides 41, which are triangular in shape and have acute angular edge portions 66 adjacent opposite sides of the outer end flaps 45. These angular edge portions 66 of the tab 65 function the same way as the slits 49 in the tabs 47 of FIG. 7. Similarly, the outer end flaps 45 have the acute angular lock edges 55 adapted for interlocking registry with the acute angular edge portions 66 as further described in detail with respect to FIGS. 21–25.

The inner end flaps 63 forming extensions of the bottom 35 are of a slightly different form whose opposite sides have V-shaped notches 67 formed therein. These provide a clearance opening through which the lock edges 55 of the outer edge flaps may project in the assembly steps shown in FIGS. 21 through 25. These figures show the self-securing box as initially formed from a blank which has been cut and scored and folded to define an open ended tube which is rectangular in cross-section and wherein the tabs and flaps are respectively coplanar with the top, bottom and sides in unfolded condition.

As a first step in FIG. 22, the tabs 65 have been folded inwardly at a 90 degree angle as designated by the arrows. In FIG. 23, the inner end flap 63 has been folded 90 degrees so as to overlap the folded tabs 65 as designated by the arrows.

In FIG. 24, the outer end flap 45 has been folded as designated by the arrows 90 degrees so as to retainingly overlie the inner end flap 63. Here the lock edges 55 are as yet not assembled but on the other hand, laterally overlie the corresponding acute angular edge portion 66 ready for the final step. In the final step shown by the arrows in FIG. 25, the respective lock edges 55 forming a part of the outer end flap 45 are manually flexed inwardly for interlocking inward projection past the notch 67 in the inner end flap and so as to extend past the angular edge portion 66 and to underlie the respective tabs 65 to effectively lock tabs and flaps together.

The construction of the angular edge portion 66 and the lock edges 55 are such that the box may be unlocked and locked a number of times without damage to the tabs or flaps, as is characteristic with many self-securing boxes known in the art. The final interlock of the lock edge 55 with respect to the interior surface of the tab 65 is similar to that shown in FIG. 17.

The exposed triangular portion of tabs 47 of FIG. 1 and tabs 65, FIG. 25 may be manually pressed in to unlock the box.

I claim:

1. A self-securing box formed from a blank, cut, scored, folded and secured to define an open ended tube having a top with foldable outer end flaps, a bottom with foldable inner end flaps and sides with foldable end tabs;

each of the tabs adjacent the outer end flaps having an acute angular edge portion therein;

the respective tabs, inner flaps and outer flaps at opposite ends of the tube being folded successively through 90 degrees into engaging registry;

the sides of the outer flaps defining lock edges inclined at an acute angle to normally overlap said tab edge portions and adapted for manual flexing interlocking inward projection respectively, so as to retainingly engage interior portions of the adjacent tabs at said edge portion, each outer flap retainingly engaging an inner flap, the opposed tabs at opposite ends of the tube being innermost, the inner end flaps overlying and retainingly engaging said tabs, and the outer end flaps having their lock edges outwardly of the inner end flaps.

2. In the self-securing box of claim 1, said angular edge portions being slits, into which said lock edges project.

3. In the self-securing box of claim 1, said tabs being triangular with one side defining said angular edge portions.

4. In the self-securing box of claim 3, the sides of the inner flaps having V-shaped notches therein, providing a clearance opening for the passage of said lock edges over said inner end flaps and behind said tabs.

5. In the self-securing box of claim 2, said slits extending at a 45 degree angle, approximately; said lock edges being inclined at a greater angle to overlap said tabs and after inward deflection to underlap said tabs, respectively.

6. In the self-securing box of claim 2, said tabs being located adjacent the opposite sides of said outer end flaps.

7. In the self-securing box of claim 3, said angular edge portions of said tabs extending at a 45° angle, approximately; said lock edges inclined at a greater angle to overlap said tabs and after inward deflection to underlap said tabs.

8. In the self-securing box of claim 2, said slits extending at an acute angle; said lock edges being inclined at a greater acute angle to overlap said tabs and after inward deflection to underlap said tabs, respectively.

9. In the self-locking box of claim 1, the dimensioning of said angular edge portions and said lock edges being such that the box ends can be opened selectively, without damage to the tabs or flaps and said lock edges reinterlocked with said angular edge portions.

10. In the self-securing box of claim 1, said inner end flaps having a height greater than said outer end flaps, so that outer end flaps overlie and retainingly engage said inner end flaps.

11. In the self-securing box of claim 1, the sides of the inner end flaps being inclined at an acute angle, whereby when said tabs and flaps are folded over and secured together, the box has the appearance of being wrapped.

12. In the self-securing box of claim 1, a hollow preformed simulated ribbon of stiff material, rectangular in longitudinal cross-section formed as a closed loop and longitudinally extending around said top bottom, and folded end flaps.

13. In the self-securing box of claim 12, said ribbon formed as a unit strip, whose free ends meet at the top thereof and are out turned to define a simulated bow; and a transverse fastener strip underlying and spanning the registering ends of said strip and secured thereto.

* * * * *